US009145750B2

(12) United States Patent
Borsheim

(10) Patent No.: US 9,145,750 B2
(45) **Date of Patent: *Sep. 29, 2015**

(54) METHOD AND DEVICE FOR EXTENDING AT LEAST THE LIFETIME OF A CHRISTMAS TREE OR AN UMBILICAL

(75) Inventor: Torfinn Borsheim, Sandnes (NO)

(73) Assignee: Subsea Solutions AS, Sandnes (NO)

( * ) Notice: Subject to any disclaimer, the term of this patent is extended or adjusted under 35 U.S.C. 154(b) by 173 days.

This patent is subject to a terminal disclaimer.

(21) Appl. No.: 13/982,735

(22) PCT Filed: Jan. 25, 2012

(86) PCT No.: PCT/NO2012/000008

§ 371 (c)(1),
(2), (4) Date: Nov. 27, 2013

(87) PCT Pub. No.: WO2013/112054

PCT Pub. Date: Aug. 1, 2013

(65) Prior Publication Data

US 2014/0151060 A1 Jun. 5, 2014

(30) Foreign Application Priority Data

Feb. 2, 2011 (NO) ..... 20110186
May 24, 2011 (NO) ..... 20110764

(51) Int. Cl.
*E21B 7/12* (2006.01)
*E21B 33/035* (2006.01)

(52) U.S. Cl.
CPC ..... *E21B 33/035* (2013.01); *E21B 33/0355* (2013.01)

(58) Field of Classification Search
CPC .... E21B 33/035; E21B 33/0355; E21B 34/04
USPC ..... 166/368
See application file for complete search history.

(56) References Cited

U.S. PATENT DOCUMENTS 3,894,560 A 7/1975 Baugh
4,174,000 A 11/1979 Milberger (Continued)

FOREIGN PATENT DOCUMENTS

WO 2008/154486 A2 12/2008

OTHER PUBLICATIONS

International Search Report for parent application PCT/NO2012/000008, having a mailing date of Apr. 24, 2012.

(Continued)

*Primary Examiner* — Matthew Buck
*Assistant Examiner* — Aaron Lembo
(74) *Attorney, Agent, or Firm* — Andrus Intellectual Property Law, LLP

(57) ABSTRACT

A method and a device are for extending at least the lifetime of a Christmas tree or an umbilical. The Christmas tree is provided with a high-pressure hydraulic valve package and a low-pressure hydraulic valve package and the umbilical includes electrical power and control cables and hydraulic pipes. The method includes: retrofitting an upgrading module including at least a control unit, a hydraulic high-pressure pump, a second high-pressure hydraulic valve package, and a hydraulic reservoir onto or at the Christmas tree; supplying the high-pressure pump, directly or via the reservoir, with hydraulic fluid from a pipe in the umbilical, the high-pressure pump being connected to the second high-pressure hydraulic valve package; connecting the second high-pressure hydraulic valve package to a downhole safety valve; connecting the electrical power and control cables of the umbilical to the control unit; and connecting control cables between the control unit and valves in the low-pressure hydraulic valve package.

11 Claims, 4 Drawing Sheets

(56) References Cited

U.S. PATENT DOCUMENTS

| | | | | |
|---|---|---|---|---|
| 4,479,546 | A * | 10/1984 | Bresie et al. | 166/369 |
| 7,111,687 | B2 * | 9/2006 | Donald et al. | 166/368 |
| 7,992,633 | B2 * | 8/2011 | Donald et al. | 166/75.12 |
| 7,992,643 | B2 * | 8/2011 | Donald et al. | 166/339 |
| 8,066,067 | B2 * | 11/2011 | Donald et al. | 166/267 |
| 8,091,630 | B2 * | 1/2012 | Donald et al. | 166/90.1 |
| 8,122,948 | B2 * | 2/2012 | Donald et al. | 166/75.12 |
| 8,167,049 | B2 * | 5/2012 | Donald et al. | 166/368 |
| 8,220,535 | B2 * | 7/2012 | Donald et al. | 166/91.1 |
| 8,272,435 | B2 * | 9/2012 | Donald et al. | 166/95.1 |
| 8,281,864 | B2 * | 10/2012 | Donald et al. | 166/368 |
| 8,297,360 | B2 * | 10/2012 | Donald et al. | 166/364 |
| 8,469,086 | B2 * | 6/2013 | Donald et al. | 166/91.1 |
| 8,540,018 | B2 * | 9/2013 | Donald et al. | 166/95.1 |
| 8,573,306 | B2 * | 11/2013 | Donald et al. | 166/344 |
| 8,622,138 | B2 * | 1/2014 | Donald et al. | 166/344 |
| 8,714,263 | B2 * | 5/2014 | Sundararajan et al. | 166/348 |
| 8,733,436 | B2 * | 5/2014 | Donald et al. | 166/91.1 |
| 8,776,893 | B2 * | 7/2014 | Donald et al. | 166/347 |
| 2005/0178560 | A1 | 8/2005 | Johansen et al. | |

OTHER PUBLICATIONS

Written Opinion for parent application PCT/NO2012/000008, having a mailing date of Apr. 25, 2012.

* cited by examiner

METHOD AND DEVICE FOR EXTENDING AT LEAST THE LIFETIME OF A CHRISTMAS TREE OR AN UMBILICAL

CROSS-REFERENCE TO RELATED APPLICATIONS

This application is the U.S. national stage application of International Application No. PCT/NO2012/000008, filed Jan. 25, 2012, which international application has not yet been published and which application is incorporated herein by reference. The International application claims priority of Norwegian Patent Application No. 20110186, filed Feb. 2, 2011, and Norwegian Patent Application No. 20110764, filed May 24, 2011, which applications are incorporated herein by reference.

BACKGROUND

This invention relates to a method of extending at least the lifetime of a Christmas tree or an umbilical. More particularly, it relates to a method of extending at least the lifetime of a Christmas tree or an umbilical, the Christmas tree being provided with a high-pressure hydraulic valve package and a low-pressure hydraulic valve package. The invention also includes a device for practising the method.

During the recovery of petroleum offshore, it has turned out that there is a need to exceed the originally intended technical-economic life of well equipment. This also applies to safety-critical components such as a Christmas tree with associated valves and control apparatuses.

A Christmas tree located on the seabed has often been guided onto a production tubing head via guide posts. The Christmas tree communicates with equipment on the surface via a so-called umbilical which may typically comprise cables for electric power and signals, optical fibres for signal transmission, pipes for hydraulic fluid under high pressure and low pressure and pipes for the supply of chemicals. It is common for the Christmas tree to be provided with a valve cap which forms a barrier between the annulus, the production bore and the surroundings. The valve cap must be removed when suitable tools that are provided with connections for liquids that are used for the removal of scale and for well-killing are to be installed.

The terms high pressure and low pressure are not exact, as they vary between the different suppliers. Roughly speaking, a pressure between 100 and 300 bars is characterized as a low pressure whereas a pressure above 300 bars is characterized as a high pressure. By pressures below 100 bars, actuators and valves may take a so-called "fail safe" position, which will often shut down the petroleum production.

The hydraulic fluids are typically carried to, respectively, a high-pressure valve package and a low-pressure valve package on the Christmas tree, the high-pressure valve package communicating with a downhole safety valve, whereas the low-pressure valve package communicates with, among other things, a number of actuators principally for valve control in the Christmas tree.

Electric power and control signals are carried to a submerged control module on or at the Christmas tree. The control module which is controlled from the surface is connected to the different hydraulic valves in the valve packages, thereby controlling the different valve functions in the Christmas tree.

Known Christmas tree installations exhibit in particular two weaknesses which emerge after a long time in operation. The control module is prone to functional faults while, at the same time, the availability of new control modules of the kind in question, and also of spare parts therefore, is limited.

The umbilical with associated components is prone to leakages.

SUMMARY

The invention has for its object to remedy or reduce at least one of the drawbacks of the prior art.

The object is achieved in accordance with the invention through the features which are specified in the description below and in the claims that follow.

A method of extending at least the lifetime of a Christmas tree or an umbilical is provided, the Christmas tree being provided with a high-pressure hydraulic valve package and a low-pressure hydraulic valve package and the umbilical including electrical power and control cables and hydraulic pipes, the method including:

- retrofitting an upgrading module including at least a control unit, a hydraulic high-pressure pump, a second high-pressure hydraulic valve package, and a hydraulic reservoir onto or at the Christmas tree;
- supplying the high-pressure pump, directly or via the reservoir, with hydraulic fluid from a pipe in the umbilical, the high-pressure pump being connected to the second high-pressure hydraulic valve package;
- connecting the second high-pressure hydraulic valve package to a downhole safety valve;
- connecting the electrical power and control cables of the umbilical to the control unit; and
- connecting control cables between the control unit and valves in the low-pressure hydraulic valve package.

By extending electrical power and control cables to a new control unit which includes at least a second high-pressure hydraulic valve package, the control unit being arranged to control existing and new valves of the Christmas tree, an existing unreliable control module is made redundant. Further, the pressure may be lowered in the high-pressure pipe of the umbilical as the high-pressure pump now provides for the supply of hydraulic fluid at sufficient pressure to the high-pressure hydraulic valve package.

Alternatively, the high-pressure pump may be supplied with hydraulic fluid from a low-pressure pipe or another pipe in the umbilical.

The method may further include:

- providing the upgrading module with a low-pressure pump which is controlled by the control unit and which is connected to valves in a second low-pressure hydraulic valve package;
- connecting a second low-pressure hydraulic valve package to actuators in the Christmas tree; and
- supplying the low-pressure pump with hydraulic fluid, directly or via a reservoir, from a pipe in the umbilical.

The hydraulic-fluid supply pipe of the umbilical may, of course, have a lower pressure than that characterized as "low pressure" in the introduction.

The method may include:

- providing the upgrading module with a chemical pump which is controlled by the control unit and which is connected to a chemical valve or directly to the production tubing;
- supplying the chemical pump with a chemical, directly or via a reservoir, from a pipe in the umbilical.

The method may include providing the upgrading module with a valve cap and placing the upgrading module on the Christmas tree after a separate valve cap has been removed.

A method of installing the upgrading module on the Christmas tree may include:

- removing the separate Christmas tree cap by means of a suitable tool;
- winching the upgrading module down to the Christmas tree;
- guiding the upgrading module in to the guide posts of the well by means of a thruster located on the upgrading module;
- lowering the upgrading module onto the guide posts; and
- connecting the Christmas tree cap of the upgrading module to the Christmas tree.

After that, the electric and hydraulic components are connected as described above.

The method can be practised by means of an upgrading module for retrofitting onto or at a Christmas tree, the Christmas tree being provided with a high-pressure hydraulic valve package and a low-pressure hydraulic valve package and the umbilical including electrical power and control cables and hydraulic pipes, the upgrading module being characterized by being provided with an electric control unit which is connectable to the power and control wires of an umbilical and includes a hydraulic high-pressure pump which is connectable directly, or indirectly via a reservoir, to the pipe of an umbilical and to at least a valve in a second high-pressure hydraulic valve package and to the control unit.

The upgrading module may be provided with a hydraulic low-pressure pump which is connectable directly, or indirectly via a reservoir, to the low-pressure hydraulic pipe of an umbilical and to at least a valve in the second low-pressure hydraulic valve package and to the control unit.

The upgrading module may be provided with an accumulator on at least the outlet of the hydraulic high-pressure pump or the hydraulic low-pressure pump.

The control unit is connected to a valve package for chemical injection.

The upgrading module may be provided with a chemical pump which is connectable directly, or indirectly via a reservoir, to the pipe of an umbilical and to at least a chemical valve or directly to the production tubing.

The upgrading module may be provided with an accumulator on the outlet of the chemical pump.

The upgrading module may be provided with a built-in Christmas tree cap and with guides that fit complementarily on the same guide posts as the Christmas tree.

The components of the upgrading module may be arranged as double systems with a main system and a backup system to ensure operation if a component should fail. The high-pressure pump and associated components may be replaced by a pressure intensifier which is supplied with fluid from a low-pressure system, for example.

It is also possible to interconnect several upgrading modules belonging to different Christmas trees, for example if the umbilical belonging to one of the Christmas trees should suffer substantial damage, or to increase the reliability of the Christmas trees in an entire area.

The method and the device according to the invention remedy weaknesses of existing control modules for Christmas trees while, at the same time, the fluid pressure in existing umbilicals may be reduced considerably. It is also possible to utilize other pipe bores in the umbilical for the supply of hydraulic fluid if a pipe bore should become unusable. By the use of a reservoir in the upgrading module, the same pipe bore in the umbilical may be used for both the supply and the return of fluid.

BRIEF DESCRIPTION OF THE DRAWINGS

In what follows is described an example of a preferred method and embodiment which is visualized in the accompanying drawings in which.

DETAILED DESCRIPTION OF THE DRAWINGS

Figure 1:
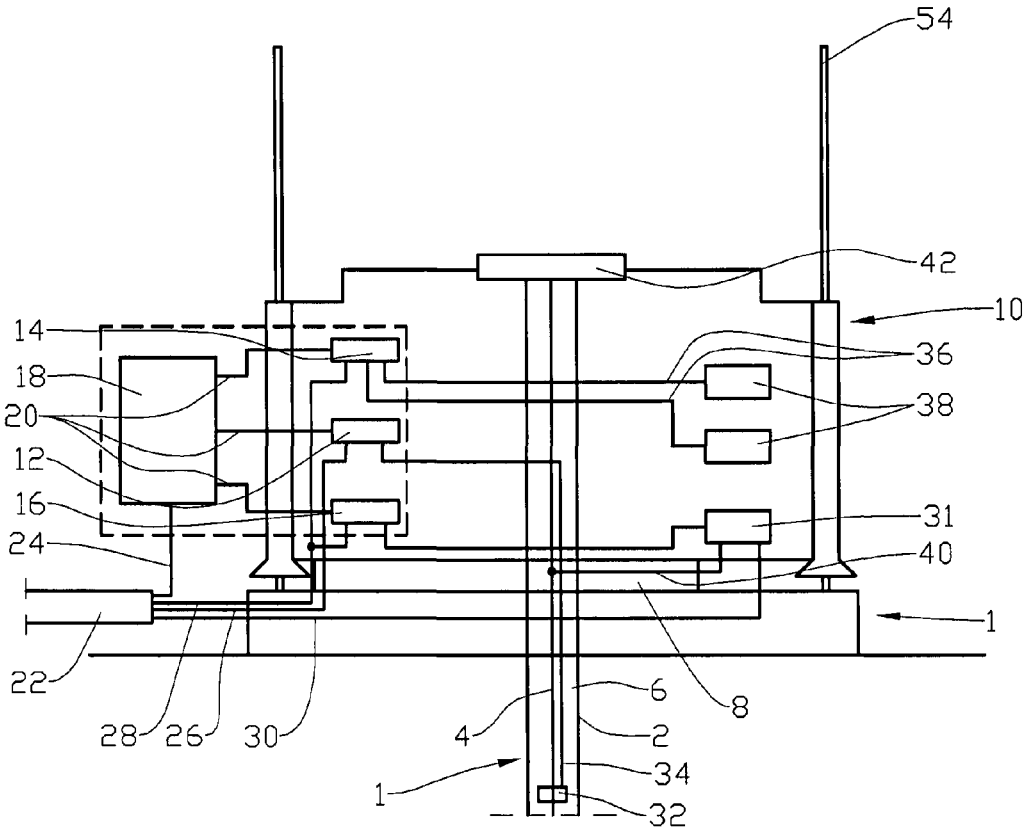
FIG. 1 shows schematically a submerged well with a prior art Christmas tree.

In the drawings, the reference numeral 1 indicates a subsea well with an outer pipe 2, for example in the form of a casing, and a production tubing 4, wherein an annulus 6 is formed between the outer pipe 2 and the production tubing 4.

The production tubing 4 is hung off in a production tubing head 8, there being a Christmas tree 10 placed on the production tubing head 8.

The Christmas tree 10 is provided with a high-pressure hydraulic valve package 12, a low-pressure hydraulic valve package 14 and a chemical valve package 16.

Via control wires 20, the different valve packages 12, 14, 16 are controlled from a control module 18 located at or on the Christmas tree 10. The valve packages 12, 14, 16 and the control module 18 are often constituted by an assembly which is indicated, in the figures, by means of a stippled rectangle.

An umbilical 22 extending to a plant, not shown, on the surface includes electrical wires 24 for electric power and control signals, a high-pressure pipe 26, a low-pressure pipe 28 and a chemical pipe 30.

The electrical wires 24 are connected to the control module 18, the high-pressure pipe 26 to the high-pressure hydraulic valve package 12, the low-pressure pipe 28 to the low-pressure hydraulic valve package 14 and the chemical pipe 30 to a chemical valve 31 which is activated by means of the chemical valve package 16.

The high-pressure hydraulic valve package 12 is connected to a downhole safety valve 32 by means of a safety-valve pipe 34. The low-pressure hydraulic valve package 14 is connected by means of actuator pipes 36 to actuators 38 in the Christmas tree. The chemical valve 31 is connected to the production tubing 4 by means of a chemical bore 40.

The Christmas tree 10 is provided with a Christmas tree cap 42 and, beyond that, includes a great number of components, not shown, which are known to a person skilled in the art.

Figure 2:
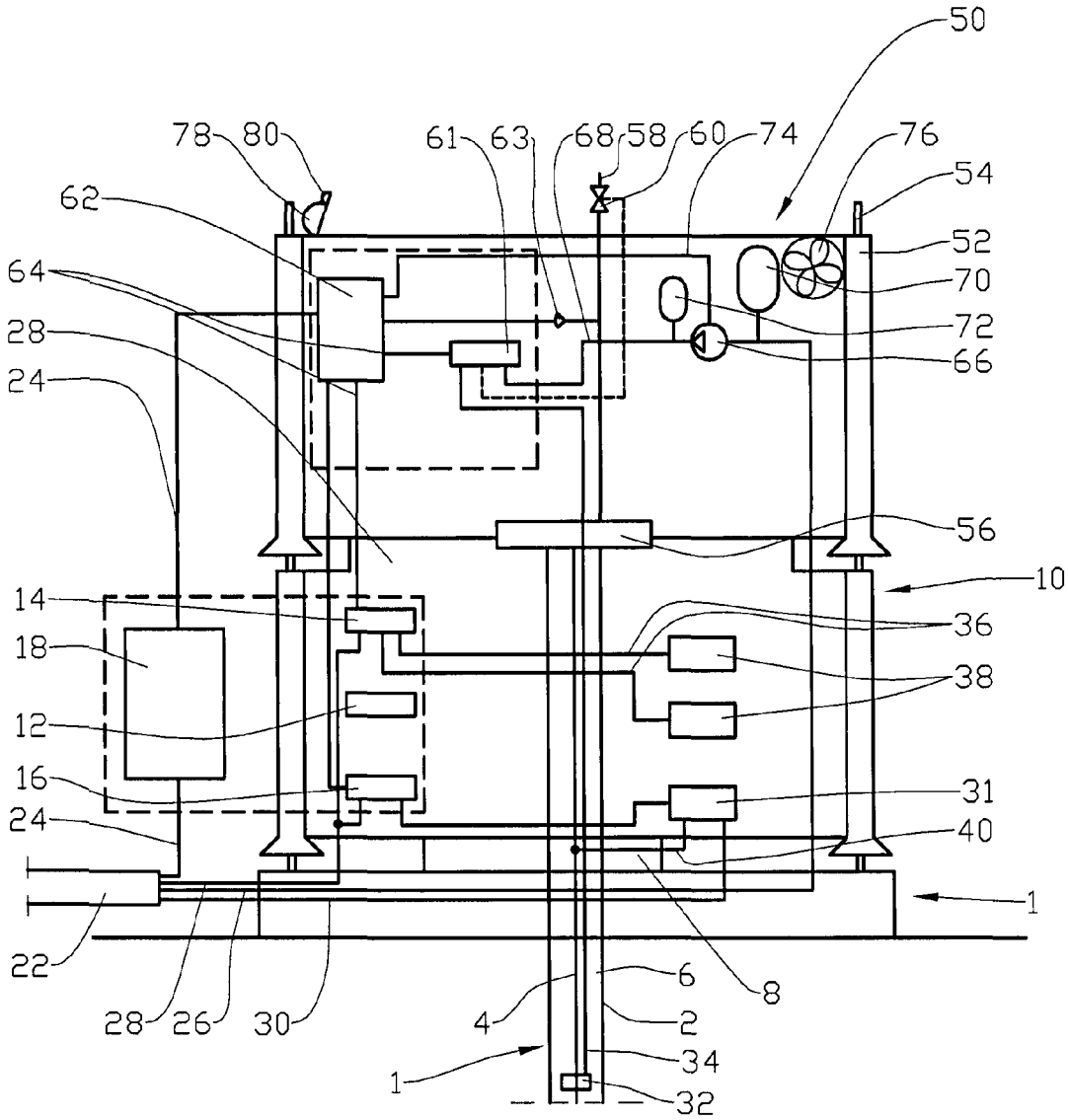
FIG. 2 shows schematically an upgrading module according to the invention, the upgrading module being positioned on the Christmas tree.

Reference is now made to FIG. 2. An upgrading module 50 is positioned on the Christmas tree 10 by means of guides 52 which fit on the guide posts 54 of the well 1. The upgrading module 50 is provided with a built-in Christmas tree cap 56 which fits complementarily on the Christmas tree 10 and which has the same functions as the Christmas tree cap 42, but which is additionally provided with a supply pipe 58 with a valve 60 for liquids used for the removal of scale and for well-killing. The valve 60 may be ROV-operated or hydraulically operated as it is indicated by the stippled line in FIGS. 2-4. The pressure below the valve 60 is measured by means of a pressure gauge 63 and the value is transmitted to the control unit 62. The purpose of the pressure gauge 63 is to enable reading of the pressure below the valve 60, for example during maintenance work. The pressure here may also reveal leakages in valves further below, for example in a swab valve, not shown.

The upgrading module 50 is provided with a second high-pressure hydraulic valve package 61 and a control unit 62, the control unit 62 being connected, directly or via the control module 18, to the electrical wires 24 of the umbilical 22, controlling the different valve packages 14, 16, 61 via the control wires 64, the control wires 20 from the control module 18 being disconnected.

A high-pressure pump 66 is located in the upgrading module 50 and is supplied with hydraulic fluid at reduced pressure from the high-pressure pipe 26 which is disconnected from the high-pressure hydraulic valve package 12. The high-pressure pump 66 is connected to the second high-pressure hydraulic valve package 61 by means of a high-pressure pipe 68. A reservoir 70 is connected to the inlet side of the high-pressure pump 66 while an accumulator 72 is connected to the outlet side of the high-pressure pump 66. The high-pressure pump 66 is controlled from the control unit 62 via a control wire 74.

Basically necessary valves that are not necessary for the explanation of the invention are not shown, as a person skilled in the art will be acquainted with the purposes and operation thereof.

In this preferred exemplary embodiment, the upgrading module 50 also includes a thruster 76, a light source 78 and a camera 80.

When the upgrading module 50 is to be installed, the original Christmas tree cap 42 is removed by mans of a suitable tool not shown. The upgrading module 50 is winched down to the Christmas tree 10, after which the upgrading module 50 remote-controlled by means of the thruster 76, light source 78 and camera 80 is positioned in such a way that the guides 52 correspond with the guide posts 54. Alternatively, a remotely operated vehicle may be used for the positioning operation.

After the upgrading module 50 has been set down on the Christmas tree 10, the Christmas tree cap 56 is connected to the Christmas tree 10. The supply of the high-pressure pump 66 is connected to the high-pressure pipe 26 of the umbilical 22, the outlet of the high-pressure pump 66 being connected to the second high-pressure hydraulic valve package 61. The electrical power and control cables 24 of the umbilical 22 are connected to the control unit 62, and control cables 64 between the control unit 62 and valves in the hydraulic valve packages 14, 16, 61 that have not been connected already are connected.

Thus, during operation, the control unit 62 has taken over at least the control functions of the control module 18, whereas the high-pressure pipe of the umbilical 22 may work at a substantially reduced pressure.

Figure 3:
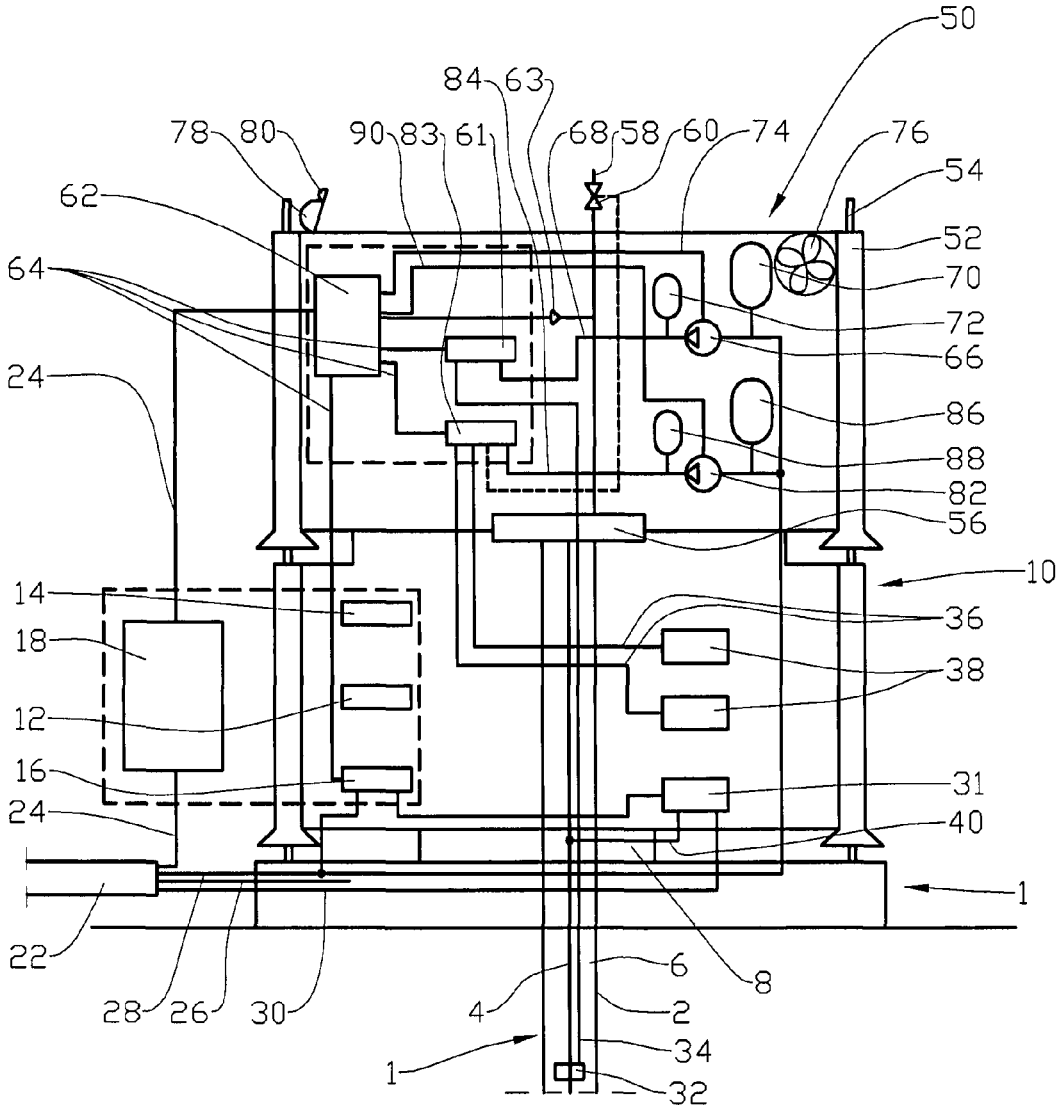
FIG. 3 shows schematically the upgrading module of FIG. 2 in an alternative embodiment.

FIG. 3 shows an alternative exemplary embodiment, in which the upgrading module is provided with a low-pressure pump 82 and is supplied with hydraulic fluid at reduced pressure from the low-pressure pipe 28 which is disconnected from the low-pressure hydraulic valve package 14. The low-pressure pump 82 is connected to a second low-pressure hydraulic valve package 83 by means of a low-pressure pipe 84. A reservoir 86 is connected to the inlet side of the low-pressure pump 82 while an accumulator 88 is connected to the outlet side of the low-pressure pump 82. The low-pressure pump 82 is controlled from the control unit 62 via a control wire 90.

In this exemplary embodiment, the high-pressure pump 66 is also supplied with hydraulic fluid via the low-pressure pipe 28.

The operation of the low-pressure pump 82 corresponds to that explained in connection with the high-pressure pump 66 above.

Figure 4:
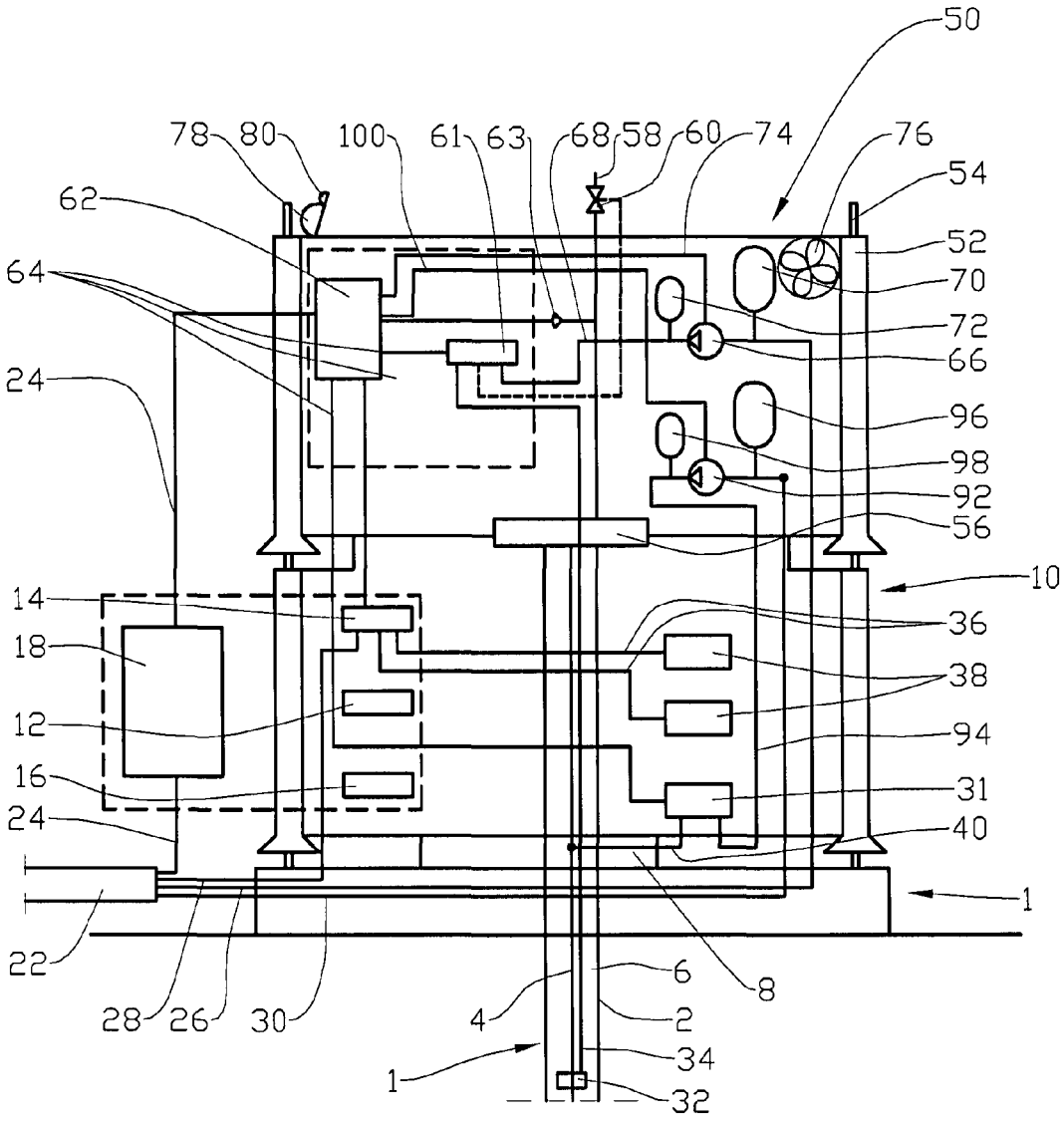
FIG. 4 shows schematically the upgrading module of FIG. 2 in a further embodiment.

FIG. 4 shows a further exemplary embodiment, in which a chemical pump 92 is arranged, which is supplied with a chemical, usually at reduced pressure, from the chemical pipe 30 which is disconnected from the chemical valve 31. The chemical pump 92 is connected to the chemical valve 31 by means of a chemical conduit 94. A reservoir 96 is connected to the inlet side of the chemical pump 92 while an accumulator 98 is connected to the outlet side of the chemical pump 92. The chemical pump 92 is controlled from the control unit 62 via a control wire 100, whereas the chemical valve 31 is controlled from the control unit 62 via a control wire 64.

The operation of the chemical pump 92 corresponds to that explained in connection with the high-pressure pump 66 above. It may be added that the reservoir 96 may be divided to be able to hold, for example, both a chemical and methanol. The methanol is supplied by means of a pipe, not shown, in the umbilical 22 and the chemical pump 92 is provided with a change-over valve, not shown, to be able to draw the desired chemical.

Whenever there is a need to remove scale or kill the well 1, liquids for this may be supplied via the supply pipe 58 without the valve cap 56 having to be removed first.

The invention claimed is:

1. A method of extending at least the lifetime of a Christmas tree or an umbilical, the Christmas tree being provided with a high-pressure hydraulic valve package and a low-pressure hydraulic valve package and the umbilical including electrical power and control cables and hydraulic pipes, the method comprising:

retrofitting an upgrading module including at least a control unit, a hydraulic high-pressure pump, a second high-pressure hydraulic valve package and a hydraulic reservoir onto or at the Christmas tree;

supplying the high-pressure pump, directly or via the reservoir, with hydraulic fluid from a pipe in the umbilical, the high-pressure pump being connected to the second high-pressure hydraulic valve package;

connecting the second high-pressure hydraulic valve package to a downhole safety valve;

connecting the electrical power and control cables of umbilical to the control unit; and connecting control cables between the control unit and valves in the low-pressure hydraulic valve package.

2. The method in accordance with claim 1, further comprising:

providing the upgrading module with a low-pressure pump which is controlled by the control unit and which is connected to valves in a second low-pressure hydraulic valve package;

connecting the second low-pressure hydraulic valve package to actuators; and supplying the low-pressure pump with hydraulic fluid, directly or via a second reservoir, from a pipe in the umbilical.

3. The method in accordance with claim 1, further comprising:

providing the upgrading module with a chemical pump which is controlled by the control unit and which is connected to a chemical valve or directly to production tubing;

supplying the chemical pump with a chemical directly or via a third reservoir from a pipe in the umbilical.

4. The method in accordance with claim 1, further comprising providing the upgrading module with a Christmas tree cap which includes a supply pipe, and placing the upgrading module on the Christmas tree after a separate valve cap has been removed.

5. An upgrading module for retrofitting onto or at a Christmas tree or an umbilical, the Christmas tree being provided with a high-pressure hydraulic valve package and a low-pressure hydraulic, valve package and the umbilical including electrical power and control cables and hydraulic pipes, the upgrading module comprising an electric control unit which is connectable to the power and control cables of the umbilical and includes a hydraulic high-pressure pump which is connectable, directly or indirectly to as reservoir, to the umbilical and to at least a valve in a second high-pressure hydraulic valve package and to the control unit.

6. The upgrading module in accordance with claim 5, wherein the upgrading, module comprises a hydraulic low-pressure pump which is connectable, directly or indirectly via a second reservoir, to the pipe of the umbilical and to at least a valve in a second low-pressure hydraulic valve package and to the control unit.

7. The upgrading module in accordance with claim 5, wherein the upgrading module comprises a chemical pump which is connectable, directly or indirectly via a third reservoir, to the pipe of the umbilical and to at least a chemical valve or directly to production tubing.

8. The upgrading module in accordance with claim 5, wherein the upgrading module is formed with a built-in Christmas tree cap which is provided with a supply pipe.

9. The upgrading module in accordance with claim 6, wherein an accumulator is connected to at least an outlet of the hydraulic high-pressure pump or the hydraulic low-pressure pump.

10. The upgrading module in accordance with claim 5, wherein the control unit is connected to a chemical valve package for chemical injection.

11. The upgrading module in accordance with claim 5, wherein the upgrading module comprises guides which fit complementarily on guide posts of a well.

* * * * *